United States Patent [19]

Rogers

[11] 4,081,028

[45] Mar. 28, 1978

[54] STEAM DISTRIBUTION SYSTEM FOR USE IN A WELL

[75] Inventor: Earl E. Rogers, Bakersfield, Calif.

[73] Assignee: Chevron Research Company, San Francisco, Calif.

[21] Appl. No.: 784,014

[22] Filed: Apr. 4, 1977

[51] Int. Cl.[2] ..... E21B 17/14

[52] U.S. Cl. ..... 166/242

[58] Field of Search ..... 166/303, 242

[56] References Cited

U.S. PATENT DOCUMENTS 2,602,600 12/1953 Baker et al. ..... 166/154

2,611,436 9/1952 Carr et al. ..... 166/269

*Primary Examiner*—James A. Leppink

*Attorney, Agent, or Firm*—R. L. Freeland, Jr.; Edward J. Keeling

[57] ABSTRACT

A steam injection system including steam deflectors connectable into a tubing string positioned in a well which steam deflectors provide for distribution of steam through the tubing string to a plurality of intervals in the well without the use of packers and from which steam enters into the well liner-tubing annulus in a direction substantially parallel to the longitudinal axis of the tubing string.

1 Claim, 9 Drawing Figures

STEAM DISTRIBUTION SYSTEM FOR USE IN A WELL

CROSS REFERENCE TO RELATED APPLICATIONS

This application is related to U.S. applications Ser. No. 783,131, filed 3/31/77, by S. O. Hutchison and G. W. Anderson and U.S. application Ser. No. 783,135, filed 3/31/77, by S. O. Hutchison and G. W. Anderson.

FIELD OF THE INVENTION

The present invention relates to a steam injection system which includes steam deflectors connectable into a tubing string located in a well. The steam deflectors are adapted to pass a portion of the steam through the tubing fitting and to also divert a portion of the steam from the interior of the tubing string into the well liner-tubing annulus at one or more vertical intervals and in a direction substantially parallel to the longitudinal axis of the tubing string.

BACKGROUND OF THE INVENTION

Steam injection is a standard technique for improving oil recovery from a well. It is often desirable to inject steam into a well at a location other than the bottom of the tubing. This is particularly true in thick formations or in formations having more than one producing interval. Heretofore the practice was to simply direct the steam into a well liner-tubing annulus in the form of a jet at right angles to the tubing string. This, however, caused damage to the liner and uniform and certain placement of the steam was not certain utilizing the prior art placement methods. The present invention provides a steam deflector injection system which overcomes these problems.

BRIEF DESCRIPTION OF THE INVENTION

The present invention provides a steam injection system for proportioning steam flow to more than one injection interval in a well and which includes steam deflectors connectable into a tubing string for passing a portion of the steam down the interior of the tubing string and for diverting a portion of the steam from the interior of the tubing string out into the well liner-tubing annulus in a direction substantially parallel to the longitudinal axis of the tubing string to prevent damage to the well liner. The steam deflectors are provided with both a central opening for stream flow down the interior of the tubing string and bypass openings for steam flow to the outside of the steam deflector. The total cross-section flow area of the bypass opening of all the steam deflectors is maintained at a value of between one-third and two-third the cross-sectional flow area of the tubing string. A plurality of steam deflectors having different sizes of bypass openings may be used to proportion the steam going to a number of steam injection intervals.

PRINCIPAL OBJECT OF THE INVENTION

The principal object of the present invention is to provide a steam injection system for directing steam into a well from the tubing string in a direction substantially parallel to the longitudinal axis of the tubing string at a plurality of different vertical intervals in proportioned quantity without using packers in the well liner-tubing annulus. Other objects and advantages of the invention will be apparent from the following specification and drawings which are incorporated herein and made a part of this specification.

DETAILED DESCRIPTION OF THE PREFERRED EMBODIMENT

Figure 1:
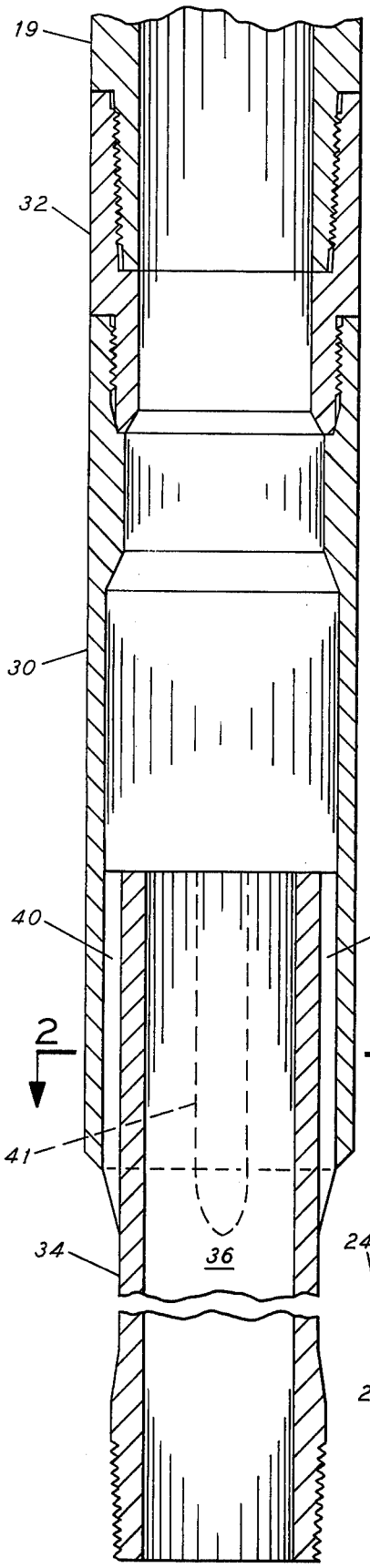
FIG. 1 is a vertical sectional view illustrating a steam deflector assembled in accordance with the present invention having highly restricted bypass flow openings for directing steam into the well liner-tubing annulus.
Figure 2:
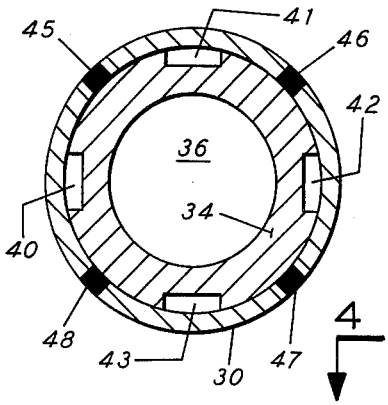
FIG. 2 is a sectional view taken at line 2—2 of FIG. 1.

FIG. 1 is a vertical sectional view illustrating a steam deflector indicated generally by the numeral 20 useful in the present invention. FIG. 2 is a sectional view taken at line 2—2 of FIG. 1. The steam deflector 20 is used to proportion steam flow down the tubing string and steam flow from the interior of the tubing string into the well annulus in a direction substantially parallel to the longitudinal axis of the tubing string. Thus, it may be desirable to inject steam both through the tubing string out the bottom thereof and to divert steam through the steam deflector into the well at a higher interval. The steam deflector 20 includes an outer tubular skirt section 30. Means, such as adapter collar 32, are provided for connecting the upper end of skirt section 30 to the tubing string 19. An inner mandrel section 34 having a central opening 36 through its entire length is arranged with its upper portion extending coaxially interiorly of the lower portion of the skirt section 30. The outer tubular skirt 30 and the mandrel section 34 are fixedly connected together such as by welds 45, 46, 47, 48. The lower end of the inner mandrel section 34 is provided with threads 37 for connecting it to the tubing string. Four bypass flow openings 40, 41, 42, 43 are formed in the mandrel section 34 and provide for diverting a portion of the steam from the interior of the deflector into the well annulus. When steam is directed into the well through the bypass openings 40—43 it enters the well in a direction substantially parallel to the longitudinal axis of the tubing string. The channels which form the bypass openings 40—43 are equally spaced apart on the outer surface of the mandrel section 34. The total cross-sectional flow area of the bypass openings 40—43 is substantially less than the cross-sectional flow area of the interior to tubing string 19.

Figure 3:
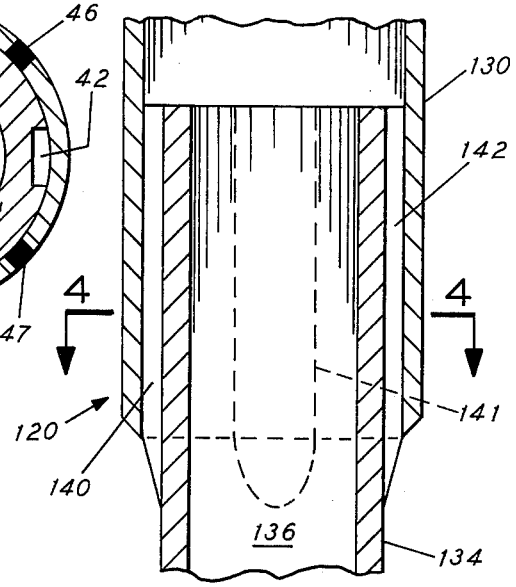
FIG. 3 is a partial vertical sectional view of a steam deflector assembled in accordance with the present invention having less restrictive bypass flow path openings for directing steam into the well liner-tubing annulus.
Figure 4:
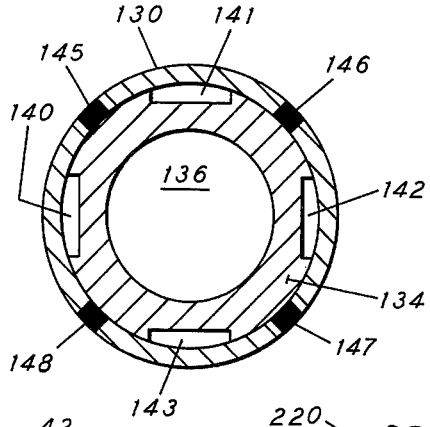
FIG. 4 is a sectional view taken at line 4—4 of FIG. 3.

FIG. 3 is a partial vertical sectional view and FIG. 4 is a sectional view taken at line 4—4 of FIG. 3 showing an embodiment of the present invention with less restrictive bypass openings than the FIG. 1 embodiment. Thus steam deflector, indicated generally by 120, includes an outer tubular skirt member 130 which is fixedly connected to an inner mandrel section 134 by suitable welds 145, 146, 147, 148. A plurality of restrictive bypass openings 140, 141, 142, 143 are formed by channels equally spaced apart on the outer surface of the mandrel section 134. These openings 140—143 have greater total cross-sectional flow area than the openings of FIG. 1 embodiment.

Figure 5:
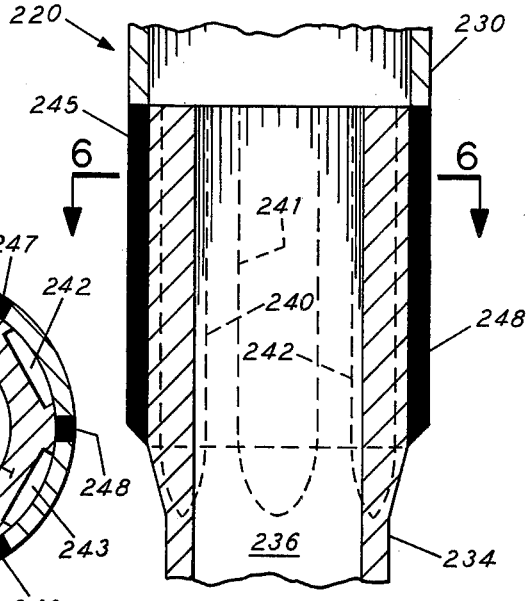
FIG. 5 is a partial vertical sectional view of a steam deflector assembled in accordance with the invention having still less restrictive bypass flow path openings for directing steam into the well liner-tubing annulus.
Figure 6:
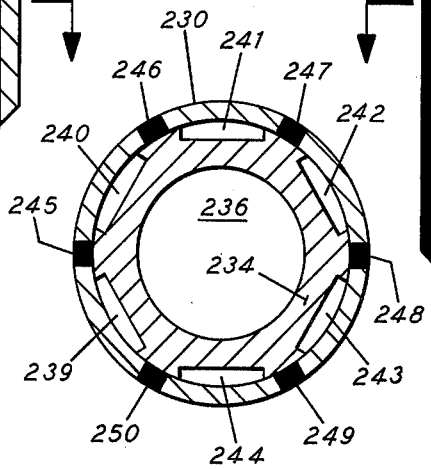
FIG. 6 is a sectional view taken at line 6—6 of FIG. 5.

FIG. 5 is a partial vertical sectional view and FIG. 6 is a sectional view taken at line 6—6 of FIG. 5 showing an embodiment of the present invention with less restrictive bypass openings than the FIG. 1 or the FIG. 3 embodiments. Thus steam deflector, indicated generally by 220, includes an outer tubular skirt member 230 which is fixedly connected to an inner mandrel section 234 by suitable welds 245, 246, 247, 248, 249, 250. A plurality of restrictive bypass openings 239, 240, 241, 242, 243, 244 are formed by channels equally spaced apart on the outer surface of the mandrel section 234. These openings 239—244 have greater total cross-sectional flow area than either the openings of the FIG. 1 or FIG. 3 embodiments.

As noted above the cross-sectional flow area of restrictive bypass openings is adjusted with limits of between one-third and two-third of the cross-sectional flow area of the tubing string to give desired steam placement at different intervals in the well. For example $2\frac{3}{8}$ inch of tubing has a cross-sectional flow area of 3.1416 square inches. Useful total bypass flow areas for the FIG. 1, FIG. 3, and FIG. 5 embodiments with this size tubing are 0.43 square inch (20); 0.60 square inch (120); and 0.90 square inch (220). The larger bypass flow areas will permit more steam to flow into the well liner-tubing annulus. Any combination of steam deflectors may be spaced apart on the tubing string so long as the total bypass flow area is equal to between one-third to two-thirds of the tubing cross-sectional flow area. It has been found that the deflector should be positioned in the well adjacent to top of a sand into which steam is to be injected. One deflector will provide steam for about the 50 vertical feet of formation immediately below its placement position.

Figure 7:
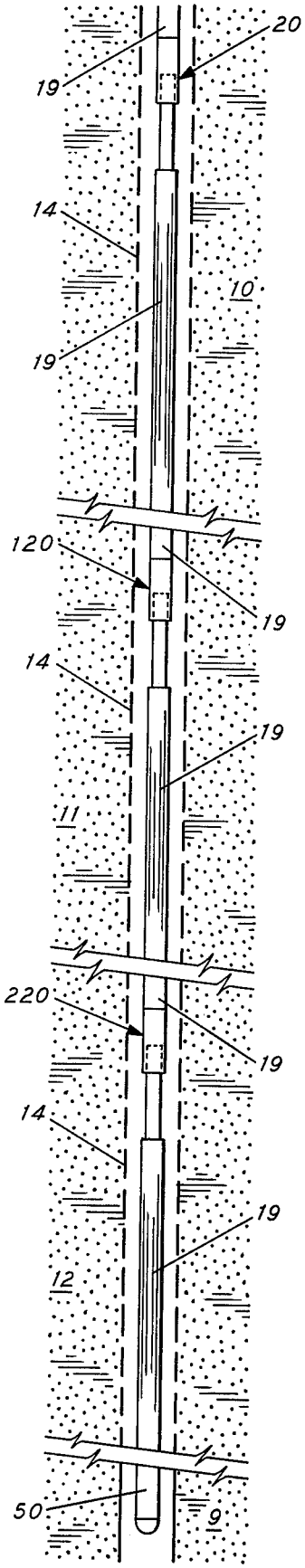
FIG. 7 is an elevation view partially in section and illustrates steam deflectors positioned on tubing located in a well.
Figure 8:
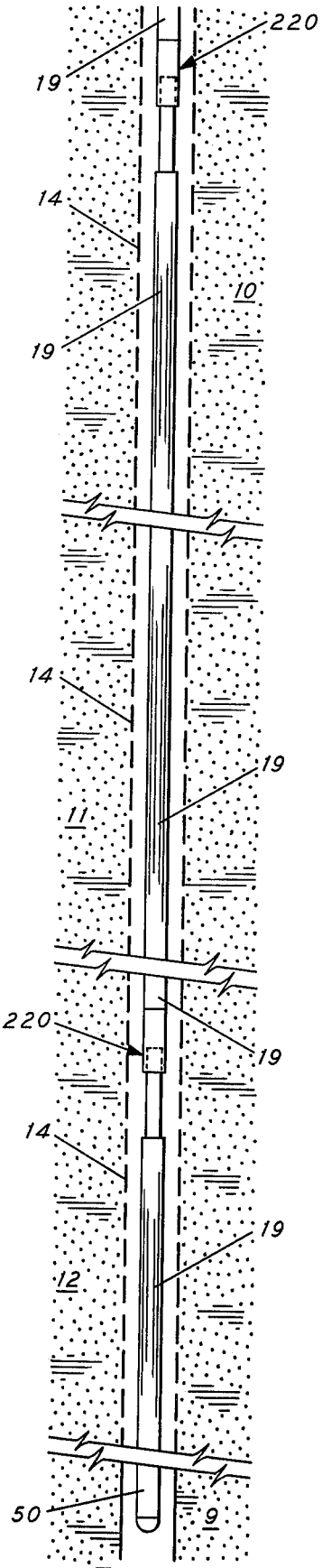
FIG. 8 is an elevation view partially in section and illustrates steam deflectors positioned on tubing located in a well.
Figure 9:
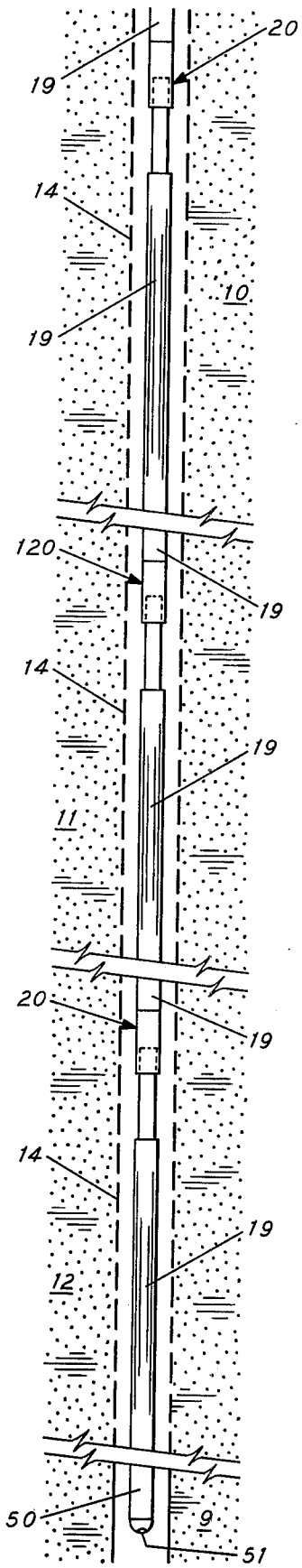
FIG. 9 is an elevation view partially in section and illustrates steam deflectors positioned on tubing located in a well.

FIGS. 7, 8, and 9 are elevation views partially in section and show steam deflectors assembled on a tubing string in a well in accordance with the present invention. Thus, in FIG. 7 a tubing string 19 is run into a well adjacent producing intervals 10, 11, 12. A production liner 14 having suitable slots or perforations is positioned adjacent the producing formations. A bull plug 50 closes off the bottom of the tubing string to flow. The tubing string is for example $2\frac{3}{8}$ inch O.D. and has a flow area of 3.1416 square inches. Thus, in accordance with the invention, the total area of the bypass openings of the deflectors should be a value from 3.1416 times $\frac{1}{3}$ to 3.1416 times $\frac{2}{3}$, or 1.03 square inches to 2.07 square inches. As noted above with this type of tubing string, the number 20 deflector would preferably have a bypass flow opening area of 0.43 square inch; the number 120 deflector would preferably have a bypass flow opening area of 0.60 square inch; and the number 220 deflector would preferably have a bypass flow opening of 0.90 square inch. Thus, the FIG. 7 configuration contains one 20 deflector; one 120 deflector and one 220 deflector having a total bypass flow area of 1.93 square inches. FIG. 8 illustrates, for example, a situation where it may be desirable to steam only the upper interval 10 and the lower interval 12. Therefore, two 220 deflectors are suitable. These two deflectors have a total bypass flow area of 1.8 square inches. FIG. 9 illustrates a situation where four intervals can be simultaneously steamed. In this embodiment the bull plug 50 is provided with a downwardly pointing jet nozzle having a flow area of 0.50 square inch. The three 20 deflectors plus the 0.50 square inch jet total 1.96 square inches ot toal steam flow area.

The present invention thus provides for steaming a plurality of vertical levels in a well simultaneously without the need for packers on the tubing string. Although certain embodiments of the invention have been described herein in detail the invention is not to be limited to only such embodiments but rather by the scope of the appended claims.

What is claimed is:

1. A steam injection system for injecting steam into a well at a plurality of different vertical intervals comprising a tubing string having a known cross-sectional flow area and at least one steam deflector connected into said tubing string adjacent at least the upper interval that is to be steamed for directing a portion of the steam down the interior of said tubing string and a portion of the steam out of the steam deflector through bypass flow openings therein into the well liner-tubing string annulus adjacent at least the upper interval that is to be steamed in a direction substantially parallel to the longitudinal axis of the tubing string, the total flow area of said bypass flow openings of all steam deflector(s) connected into said tubing string plus any other flow opening in said tubing string below the steam deflector(s) being from $\frac{1}{3}$ to $\frac{2}{3}$ of the total flow area of the tubing string.

* * * * *